US006364590B1

(12) United States Patent
Gayoso

(10) Patent No.: US 6,364,590 B1
(45) Date of Patent: Apr. 2, 2002

(54) BOOK COVER PREPARATION SYSTEM

(75) Inventor: Maximo Gayoso, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/630,297

(22) Filed: Aug. 1, 2000

(51) Int. Cl.[7] ..... B42C 11/00

(52) U.S. Cl. ..... 412/18; 83/879; 270/52.08; 412/1; 412/9; 412/22; 493/396

(58) Field of Search ..... 412/1, 4, 9, 18, 412/19, 22, 25, 33; 270/52.01, 52.08, 58.08; 493/228, 396; 83/879, 880

(56) References Cited

U.S. PATENT DOCUMENTS

| | | | | |
|---|---|---|---|---|
| 4,075,726 A | | 2/1978 | Korsgaard | 11/1 R |
| 4,179,325 A | * | 12/1979 | Staats et al. | 156/498 |
| 4,367,061 A | | 1/1983 | Wiholm | 412/3 |
| 4,505,629 A | | 3/1985 | Lynch | 412/5 |
| 4,606,689 A | | 8/1986 | Wiholm | 412/3 |
| 5,044,857 A | | 9/1991 | Crudo | 412/19 |
| 5,207,632 A | * | 5/1993 | Brunlid | 493/355 |
| 5,220,858 A | * | 6/1993 | Allen et al. | 83/880 |
| 5,364,215 A | | 11/1994 | Snellman et al. | 412/3 |
| 5,393,295 A | * | 2/1995 | Knecht | 493/403 |
| 5,465,213 A | | 11/1995 | Ross | 364/468 |
| 5,855,543 A | * | 1/1999 | Carbone | 493/59 |
| 5,868,539 A | | 2/1999 | Rathert | 412/5 |
| 5,873,807 A | * | 2/1999 | Lauderbaugh et al. | 493/403 |
| 5,913,765 A | * | 6/1999 | Burgess et al. | 493/403 |
| 5,921,752 A | * | 7/1999 | Sinke et al. | 416/16 |
| 6,012,890 A | | 1/2000 | Celorio Garrido | 412/19 |
| 6,071,225 A | * | 6/2000 | Kucharski | 493/471 |
| 6,162,155 A | * | 12/2000 | Gordon et al. | 493/59 |

* cited by examiner

*Primary Examiner*—A. L. Wellington
*Assistant Examiner*—Monica Carter

(57) ABSTRACT

An apparatus for forming scorelines in a book cover includes a pair of scoring counter-bars and a pair of scoring tools. Each of the scoring counter-bars include a longitudinal indentation provided therein and each of the scoring tools include a scoring protrusion provided thereon. The scoring protrusion of one of the scoring tools engages the longitudinal indentation of an associated one of the scoring counter-bars so as to form scorelines in the book cover when the book cover is positioned between the scoring counter-bars and the scoring tools.

28 Claims, 7 Drawing Sheets

BOOK COVER PREPARATION SYSTEM

THE FIELD OF THE INVENTION

The present invention relates generally to book forming and, more particularly, to a system for forming fold-lines in a book cover prior to binding of a book block with the book cover.

BACKGROUND OF THE INVENTION

In making a book, a book block (i.e., a plurality of sheets of paper) is typically bound with a book cover by a book binder. The book block includes a body of the book having, for example, a table of contents, text, index, etc. Typically, the book cover is one sheet or piece of material cut to a desired size and includes a front cover, a back cover, and a cover spine provided between the front cover and the back cover.

With a conventional book forming system, the book cover is positioned in a book binder and the book block is positioned relative to the book cover such that a spine of the book block is bound with the cover spine of the book cover. As such, the front cover and the rear cover are openable relative to the cover spine. To facilitate opening of the front cover and/or the back cover relative to the cover spine, fold-lines can be provided in the book cover along lateral edges of the cover spine. Unfortunately, conventional systems for forming fold-lines in the book cover are often very complex and not easily reconfigured for processing differing book covers.

Accordingly, a need exists for efficiently forming scorelines in a book cover prior to binding of a book block with the book cover such that precise fold-lines are provided along lateral edges of the cover spine.

SUMMARY OF THE INVENTION

One aspect of the present invention provides an apparatus for forming scorelines in a book cover. The apparatus includes a pair of scoring counter-bars and a pair of scoring tools. Each the scoring counter-bars have a longitudinal axis and a first surface substantially parallel with the longitudinal axis. Each of the scoring counter-bars include a first longitudinal indentation provided in the first surface thereof and each of the scoring tools include a scoring protrusion provided thereon. As such, the scoring protrusion of one of the scoring tools is adapted to engage the first longitudinal indentation of an associated one of the scoring counter-bars.

In one embodiment, the pair of scoring tools includes a pair of scoring wheels. As such, the scoring protrusion of each of the scoring tools is a circumferential scoring protrusion. In one embodiment, the pair of scoring tools includes a pair of scoring bars. As such, the scoring protrusion of each of the scoring tools is a longitudinal scoring protrusion.

In one embodiment, each of the scoring counter-bars includes a longitudinal protrusion provided on the first surface thereof and each of the scoring tools includes a scoring indentation provided therein. As such, the scoring indentation of the one of the scoring tools is adapted to receive the longitudinal protrusion of the associated one of the scoring counter-bars.

In one embodiment, each of the scoring counter-bars have a second surface substantially parallel with the longitudinal axis thereof. As such, each of the scoring counter-bars include a second longitudinal indentation provided in the second surface thereof and a longitudinal protrusion provided on the second surface thereof. In addition, each of the scoring tools includes a scoring indentation provided therein. Thus, the scoring indentation of the one of the scoring tools is adapted to receive the longitudinal protrusion of the associated one of the scoring counter-bars and the scoring protrusion of the one of the scoring tools is adapted to engage the second longitudinal indentation of the associated one of the scoring counter-bars.

In addition, in one embodiment, the second surface of each of the scoring counter-bars is substantially perpendicular to the first surface thereof and each of the scoring counter-bars is rotatable about the longitudinal axis thereof. More specifically, each of the scoring counter-bars is rotatable between a first position which facilitates engagement of the first longitudinal indentation of one of the scoring counter-bars by the scoring protrusion of an associated one of the scoring tools and a second position which facilitates engagement of the second longitudinal indentation of the one of the scoring counter-bars by the scoring protrusion of the associated one of the scoring tools.

Furthermore, in one embodiment, the pair of scoring tools includes a pair of scoring wheels. As such, the scoring protrusion of each of the scoring tools is a circumferential scoring protrusion and the scoring indentation of each of the scoring tools is a circumferential scoring indentation. In one embodiment, the pair of scoring tools includes a pair of scoring bars. As such, the scoring protrusion of each of the scoring tools is a longitudinal scoring protrusion and the scoring indentation of each of the scoring tools is a longitudinal scoring indentation.

In one embodiment, at least one of the scoring counter-bars and an associated one of the scoring tools are jointly adjustable laterally. In one embodiment, a first of the scoring counter-bars and an associated one of the scoring tools are jointly adjustable laterally in a first direction substantially perpendicular to the longitudinal axis of the first of the scoring counter-bars, and a second of the scoring counter-bars and an associated one of the scoring tools are jointly adjustable laterally in a second direction substantially perpendicular to the longitudinal axis of the second of the scoring counter-bars, wherein the second direction is opposite to the first direction.

In one embodiment, one of the scoring counter-bars and an associated one of the scoring tools are spaced a predetermined distance from another of the scoring counter-bars and an associated one of the scoring tools based on a thickness of a book block adapted to be bound with the book cover.

In one embodiment, the apparatus further includes a controller which controls the scoring counter-bars and the scoring tools.

Another aspect of the present invention provides an apparatus for forming scorelines in a book cover. The apparatus includes a pair of scoring counter-bars and a pair of scoring tools. Each of the scoring counter-bars have a longitudinal axis and a first surface substantially parallel with the longitudinal axis. Each of the scoring counter-bars include a first indentation provided in the first surface thereof and a first protrusion provided on the first surface thereof, wherein the first indentation and the first protrusion of each of the scoring counter-bars extends longitudinally along the first surface thereof substantially parallel with the longitudinal axis thereof. In addition, each of the scoring tools include a scoring protrusion adapted to engage the first indentation of an associated one of the scoring counter-bars and a scoring indentation adapted to receive the first protrusion of the associated one of the scoring counter-bars.

Another aspect of the present invention provides a method of preparing a book cover prior to binding of a book block with the book cover. The method includes the steps of providing a pair of scoring counter-bars and a pair of scoring tools, establishing a thickness of the book block, spacing the pair of scoring counter-bars and the pair of scoring tools based on the established thickness of the book block, positioning the book cover between the pair of scoring counter-bars and the pair of scoring tools, and applying pressure to the book cover from the pair of scoring counter-bars and the pair of scoring tools to form a first pair of scorelines in the book cover.

Another aspect of the present invention provides a system for producing a book on-demand. The system includes a processing system adapted to receive and process a book request for the book, a book block preparation system which prepares a book block of the book in response to a book body preparation command of the processing system, a book cover preparation system which prepares a book cover of the book in response to a book cover preparation command of the processing system, and a book finishing system which assembles the book block and the book cover to form the book. In one embodiment, the book cover preparation system includes a pair of scoring counter-bars and a pair of scoring tools. Each the scoring counter-bars have a longitudinal axis and a first surface substantially parallel with the longitudinal axis. Each of the scoring counter-bars include a first longitudinal indentation provided in the first surface thereof and each of the scoring tools include a scoring protrusion provided thereon. As such, the scoring protrusion of one of the scoring tools is adapted to engage the first longitudinal indentation of an associated one of the scoring counter-bars.

Another aspect of the present invention provides a method of producing a book on-demand. The method includes the steps of receiving and processing a book request for the book, preparing a book block of the book in response to a book body preparation command of the processing system, preparing a book cover of the book in response to a book cover preparation command of the processing system, and assembling the book block and the book cover to form the book. In one embodiment, the step of preparing the book cover includes the steps of providing a pair of scoring counter-bars and a pair of scoring tools, establishing a thickness of the book block, spacing the pair of scoring counter-bars and the pair of scoring tools based on the established thickness of the book block, positioning the book cover between the pair of scoring counter-bars and the pair of scoring tools, and applying pressure to the book cover from the pair of scoring counter-bars and the pair of scoring tools to form a first pair of scorelines in the book cover.

The present invention provides a system for forming scorelines in a book cover prior to binding of a book block with the book cover. As such, precise fold-lines are provided along lateral edges of a cover spine of the book cover.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1A:
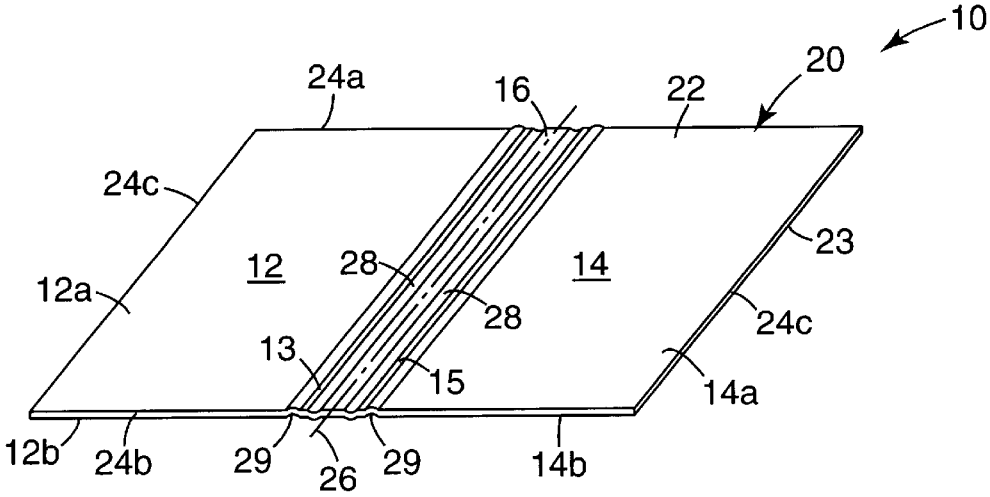
FIG. 1A illustrates one exemplary embodiment of a book cover prepared according to the present invention.

The present invention provides a system for forming scorelines in a book cover prior to binding of a book block with the book cover. As such, precise fold-lines are provided along lateral edges of a cover spine of the book cover. One exemplary embodiment of a book cover prepared according to the present invention is illustrated generally at 10 in FIG. 1A. Book cover 10 includes a cover blank 20 formed from a sheet or piece of material cut to a desired size. In addition, book cover 10 can include a cover image (not shown) provided on cover blank 20. The cover image can include, for example, images in the form of characters and/or graphics as is well know in the art. Cover blank 20 is made from sheet material such as paper, cardboard, and/or plastic film suitable for forming book cover 10. Thickness of cover blank 20 can vary according to a desired durability of book cover 10. Thickness of cover blank 20 can include, for example, 8, 10, or 12 mil.

Cover blank 20 includes a first major surface 22 and a second major surface 23, and is substantially rectangular in shape. As such, cover blank 20 includes a top edge 24*a*, a bottom edge 24*b*, and a pair of side edges 24*c*. Bottom edge 24*b* is spaced from and substantially parallel with top edge 24*a*, and side edges 24*c* are substantially parallel with each other and substantially perpendicular to top edge 24*a* and bottom edge 24*b*. Cover blank 20 has a centerline 26 positioned substantially equidistant between and oriented substantially parallel with side edges 24*c*. Centerline 26 is also oriented substantially perpendicular to top edge 24*a* and bottom edge 24*b* so as to bisect top edge 24*a* and bottom edge 24*b*.

In one exemplary embodiment, cover blank 20 includes a first pair of scorelines 28 and a second pair of scorelines 29. Scorelines 28 and scorelines 29, also referred to as hinge or fold-lines, are formed by impressions or creases made in cover blank 20 to help position and facilitate folds of book cover 10. Scorelines 28 are spaced from and oriented substantially parallel with each other, and scorelines 29 are spaced from and oriented substantially parallel with each other. In addition, scorelines 28 and scorelines 29 are each oriented substantially parallel with centerline 26 of cover blank 20 and extend from top edge 24*a* to bottom edge 24*b*.

In one exemplary embodiment, scorelines 28 are spaced equidistant from centerline 26 of cover blank 20 and scorelines 29 are spaced equidistant from scorelines 28 and, therefore, centerline 26 of cover blank 20. As such, scorelines 29 are parallel with and spaced laterally outside scorelines 28. Thus, scorelines 29 are centered about scorelines 28. Furthermore, scorelines 29 are inverted relative to scorelines 28. More specifically, scorelines 28 are formed in first major surface 22 of cover blank 20 and scorelines 29 are formed in second major surface 23 of cover blank 20.

In one exemplary embodiment, scorelines 28 form spaced longitudinal impressions in first major surface 22 of cover blank 20 and scorelines 29 form spaced longitudinal impressions in second major surface 23 of cover blank 20. Furthermore, scorelines 28 form spaced longitudinal protrusions on second major surface 23 of cover blank 20 and scorelines 29 form spaced longitudinal protrusions on first major surface 22 of cover blank 20. As such, scorelines 28 and scorelines 29 define a front cover 12 of book cover 10, a back cover 14 of cover 10, and a cover spine 16 of book cover 10. More specifically, front cover 12 is defined generally between one scoreline 29 and one side edge 24*c*, and back cover 14 is defined generally between the other scoreline 29 and the other side edge 24*c*. In addition, cover spine 16 is defined generally between scorelines 28 such that cover spine 16 is centered about centerline 26 of cover blank 20. Furthermore, a front cover spine portion 13 is defined generally between one scoreline 28 and one scoreline 29 adjacent front cover 12, and a back cover spine portion 15 is generally defined between the other scoreline 28 and the other scoreline 29 adjacent back cover 14.

In one exemplary embodiment, first major surface 22 of cover blank 20 forms an inner surface 12*a* of front cover 12 and an inner surface 14*a* of back cover 14. In addition, second major surface 23 of cover blank 20 forms an outer surface 12*b* of front cover 12 and an outer surface 14*b* of back cover 14. Thus, scorelines 28 facilitate folding of inner surface 12*a* of front cover 12 (including front cover spine portion 13) and inner surface 14a of back cover 14 (including back cover spine portion 15) toward each other relative to cover spine 16. Scorelines 29, however, facilitate folding of outer surface 12*b* of front cover 12 and outer surface 14*b* of back cover 14 toward each other relative to cover spine 16 (including front cover spine portion 13 and back cover spine portion 15).

Figure 1B:
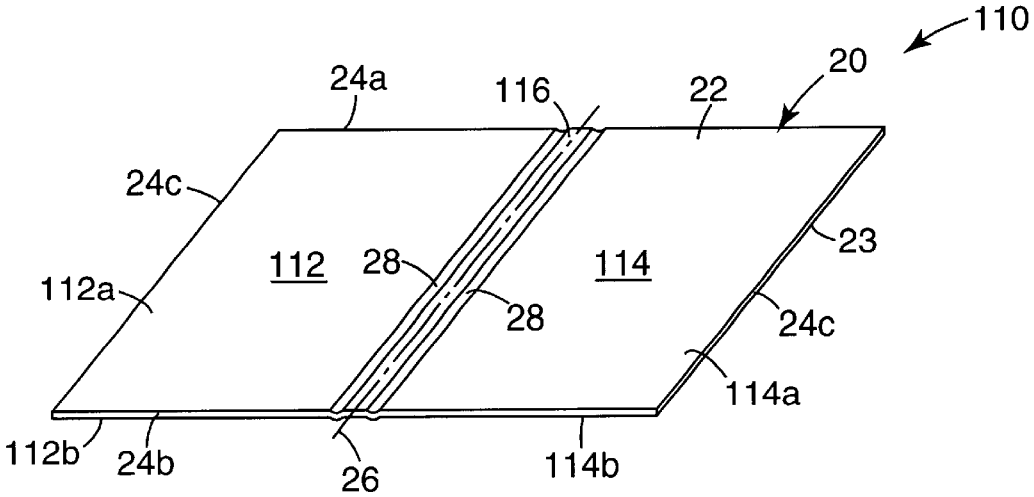
FIG. 1B illustrates another exemplary embodiment of a book cover prepared according to the present invention.

Another exemplary embodiment of a book cover prepared according to the present invention is illustrated generally at 110 in FIG. 1B. Book cover 110 is similar to book cover 10 with the exception that book cover 10 does not include scorelines 29. As such, scorelines 28 define a front cover 112 of book cover 110, a back cover 114 of book cover 110, and a cover spine 116 of book cover 110. More specifically, front cover 112 is defined generally between one scoreline 28 and one side edge 24*c*, and back cover 114 is defined generally between the other scoreline 28 and the other side edge 24*c*. In addition, cover spine 116 is defined generally between scorelines 28 such that cover spine 116 is centered about centerline 26 of cover blank 20.

In one exemplary embodiment, first major surface 22 of cover blank 20 forms an inner surface 112*a* of front cover 112 and an inner surface 114*a* of back cover 114. In addition, second major surface 23 of cover blank 20 forms an outer surface 112*b* of front cover 112 and an outer surface 114*b* of back cover 114. Thus, scorelines 28 facilitate folding of inner surface 112*a* of front cover 112 and inner surface 114*a* of back cover 114 toward each other relative to cover spine 116.

Figure 2A:
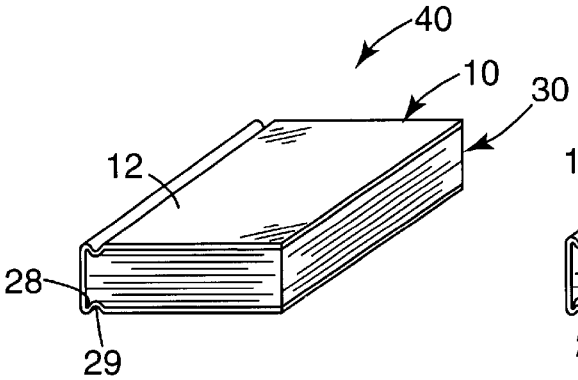
FIG. 2A illustrates one exemplary embodiment of a book block bound with the book cover of FIG. 1A.
Figure 2B:
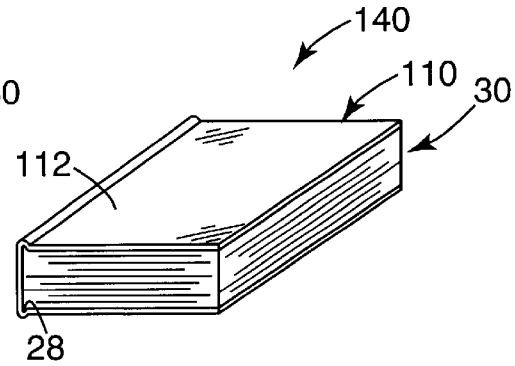
FIG. 2B illustrates another exemplary embodiment of a book block bound with the book cover of FIG. 1B.

In use, book covers 10 and 110 bind a book block 30 to form books 40 and 140, respectively, as illustrated in FIGS. 2A and 2B. A width of cover spines 16 and 116 is based on a thickness of book block 30. A distance between scorelines 28, therefore, is also based on the thickness of book block 30. In one exemplary embodiment, centerline 26 of cover blank 20 coincides with a centerline of cover spines 16 and 116. As such, scorelines 28 and, therefore, scorelines 29 are centered within cover blank 20. It is, however, within the scope of the present invention for the centerline of cover spines 16 and 116 to be offset from centerline 26 of cover blank 20.

Figure 3:
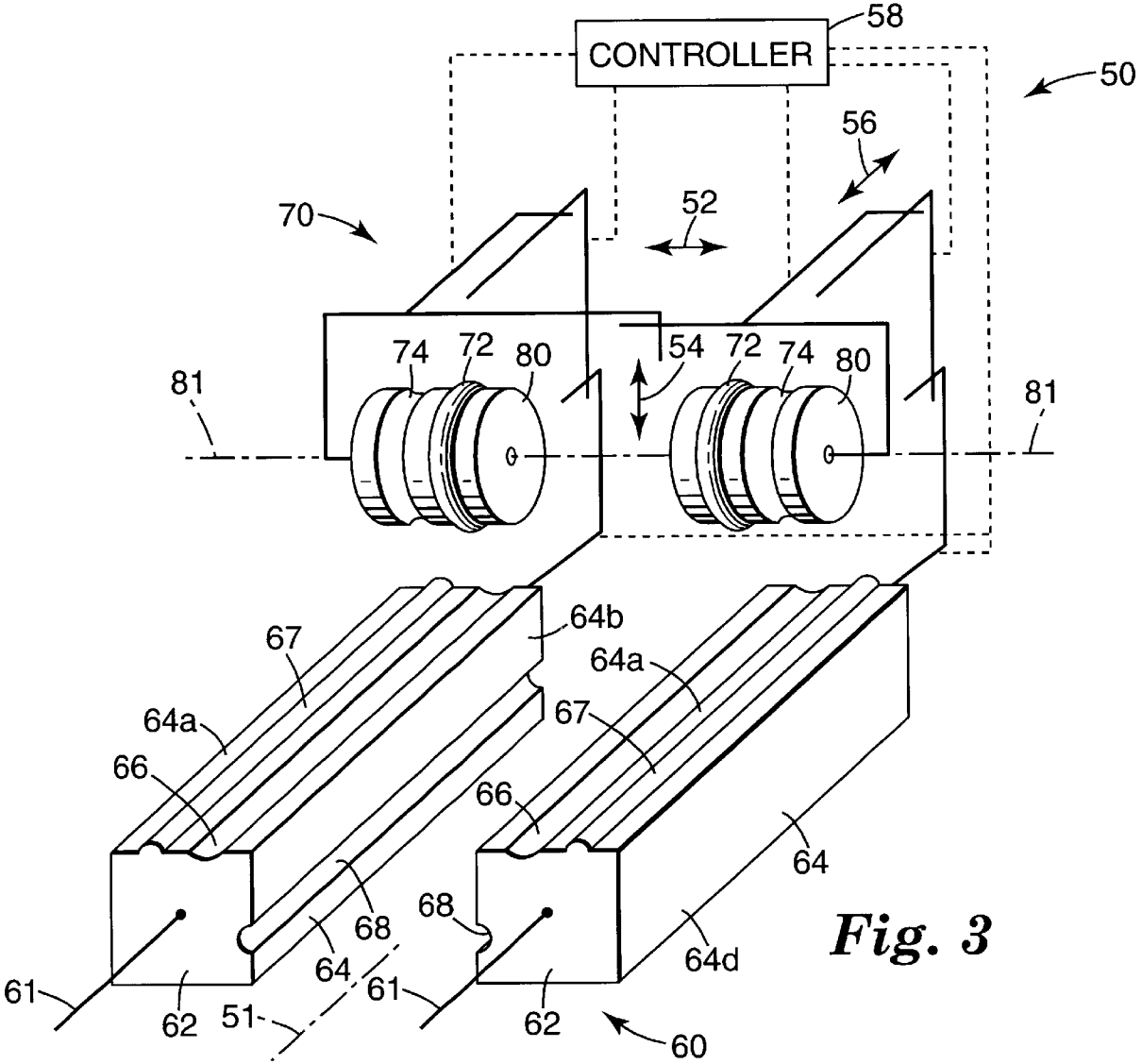
FIG. 3 is a schematic illustration of one exemplary embodiment of a portion of a scoring apparatus for forming scorelines in a book cover according to the present invention.

One exemplary embodiment of a portion of a scoring apparatus for forming scorelines 28 and scorelines 29 in book cover 10 and scorelines 28 in book cover 110 is illustrated generally at 50 in FIG. 3. Scoring apparatus 50 includes a pair of scoring counter-bars 60 and a pair of scoring tools 70. Scoring apparatus 50 includes an operational centerline 51 about which scoring counter-bars 60 and scoring tools 70 are spaced. Scoring counter-bars 60 and scoring tools 70 cooperate to form scorelines 28 and scorelines 29 in book cover 10 and scorelines 28 in book cover 110. As such, one of the scoring counter-bars 60 is associated with one of the scoring tools 70 and, vice versa.

In one exemplary embodiment, scoring counter-bars 60 each have a longitudinal axis 61 and are oriented substantially parallel to each other. Scoring counter-bars 60 each have a pair of end surfaces 62 (only one of which is illustrated) through which longitudinal axis 61 extends. In addition, scoring counter-bars 60 each include side surfaces 64 extending between end surfaces 62 parallel with longitudinal axis 61.

As illustrated in FIG. 3, scoring counter-bars 60 each have a generally rectangular cross-section. Thus, side surfaces 64 include four side surfaces 64*a*, 64*b*, 64*c*, and 64*d* oriented substantially perpendicular to each other. As such, side surface 64*a* faces scoring tools 70 and side surface 64*b* faces centerline 51 of scoring apparatus 50 and, therefore, the other scoring counter-bar 60. Thus, side surface 64*c* is opposite side surface 64*a* and side surface 64*d* is opposite side surface 64*b*. It is, however, within the scope of the present invention for scoring counter-bar 60 to have other multi-side cross-sectional profiles.

In one exemplary embodiment, scoring counter-bars 60 each include an indentation or groove 66 formed in one of the side surfaces 64, for example, side surface 64*a*, and a protrusion or rib 67 formed on the same side surface 64*a*. Rib 67 is spaced from and substantially parallel with groove 66. As such, groove 66 and rib 67 each extend longitudinally along side surface 64*a* substantially parallel with longitudinal axis 61. In addition, scoring counter-bars 60 each include a groove 66 formed in another of the side surfaces 64, for example, side surface 64*b*. As such, groove 66 extends longitudinally along side surface 64*b* substantially parallel with longitudinal axis 61.

Figure 4A:
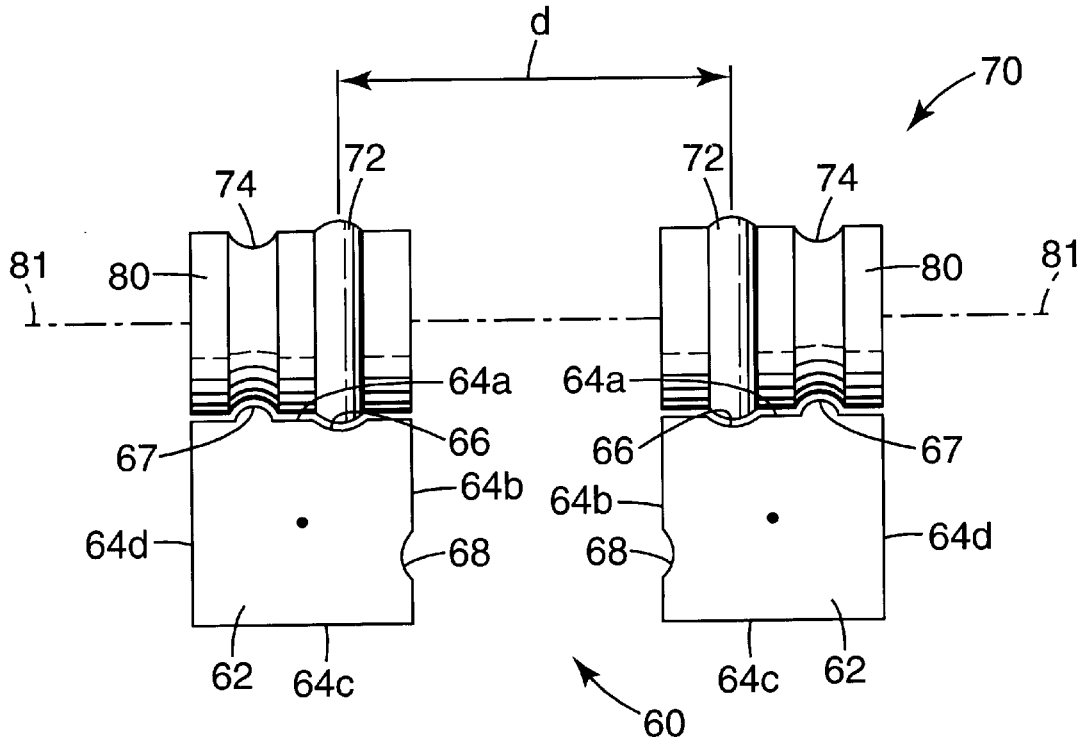
FIG. 4A is an end view of a portion of the scoring apparatus of FIG. 3.

In one exemplary embodiment, scoring tools 70 each include a scoring protrusion or rib 72 and a scoring indentation or groove 74, and scoring counter-bars are each rotatable about longitudinal axis 61. More specifically, scoring counter-bars 60 are each rotatable between a first position (FIGS. 3 and 5A) and a second position (FIG. 5B) depending on whether both scorelines 28 and scorelines 29 are to be found in cover blank 20 or only scorelines 28 are to be formed in cover blank 20. In the first position, scoring rib 72 of each of the scoring tools 70 cooperates with groove 66 of an associated one of the scoring counter-bars 60 and scoring groove 74 of each of the scoring tools 70 cooperates with rib 67 of the associated scoring counter-bars 60 (FIG. 4A). In the second position, scoring rib 72 of each of the scoring tools 70 cooperates with groove 68 of the associated scoring counter-bars 60 (FIG. 5B).

In one exemplary embodiment, scoring counter-bars 60 and scoring tools 70 are jointly adjustable laterally as represented by arrow 52 in FIG. 3. More specifically, one of the scoring counter-bars 60 and an associated one of the scoring tools 70 are adjustable in a direction substantially perpendicular to longitudinal axis 61. It is within the scope of the present invention for one of the scoring counter-bars 60 and the associated scoring tool 70 to be laterally adjustable relative to the other scoring counter-bar 60 and the associated scoring tool 70 or for both scoring counter-bars 60 and the associated scoring tools 70 to be laterally adjustable relative to each other. In addition, scoring counter-bars 60 and scoring tools 70 are vertically adjustable relative to each other as represented by arrow 54 in FIG. 3. It is within the scope of the present invention for both scoring counter-bars 60 to be vertically adjustable relative to the associated scoring tools 70, for both scoring tools 70 to be vertically adjustable relative to the associated scoring counter-bars 60, or for both scoring counter-bars 60 and both scoring tools 70 to be vertically adjustable relative to each other.

In one exemplary embodiment, the pair of scoring tools 70 includes a pair of scoring wheels 80. As such, scoring wheels 80 are generally cylindrical in shape. Thus, scoring rib 72 of each of the scoring tools 70 extends circumferentially around a corresponding one of the scoring wheels 80 and scoring groove 74 of each of the scoring tools 70 extends circumferentially around the corresponding scoring wheels 80.

In one exemplary embodiment, scoring wheels 80 are each rotatably mounted about an axis 81 and one of the scoring wheels 80 cooperates with one of the scoring counter-bars 60. Axis 81 is oriented substantially perpendicular to longitudinal axis 61 of scoring counter-bars 60. As such, scoring wheels 80 are moveable along scoring counter-bars 60 as represented by arrow 56 in FIG. 3. Thus, point contact is provided between scoring wheels 80 and scoring counter-bars 60 as scoring wheels 80 roll along scoring counter-bars 60.

In one exemplary embodiment, operation of scoring apparatus 50 is controlled by a controller 58. Controller 58 controls, for example, lateral and vertical adjustment of scoring counter-bars 60 and scoring tools 70 as well as other operations of scoring counter-bars 60 and scoring tools 70 as described herein.

Figure 4B:
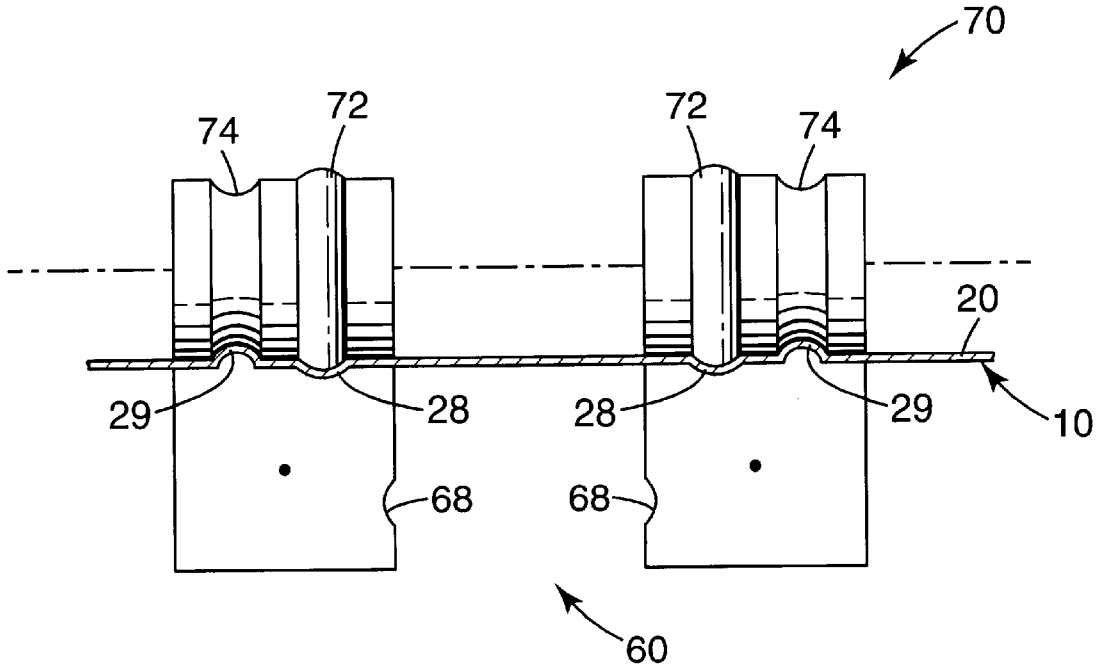
FIG. 4B is an end view illustrating one exemplary embodiment of forming scorelines in a book cover positioned in the scoring apparatus of FIG. 3.

FIGS. 4A and 4B illustrate one exemplary embodiment of forming scorelines 28 and scorelines 29 in cover blank 20 with scoring apparatus 50 to form book cover 10. As illustrated in FIG. 4A, one of the scoring counter-bars 60 and the associated scoring tool 70 are spaced a predetermined distance d from the other scoring counter-bar 60 and the associated scoring tool 70. Predetermined distance d is based on a thickness of book block 30 and is measured, for example, between scoring rib 72 of one of the scoring tools 70 and scoring rib 72 of the other scoring tool 70.

The thickness of book block 30 is established, for example, by actual or inferred measurement. Actual measurement includes, for example, visual or physical sensing of the thickness of book block 30. Inferred measurement includes, for example, a count of a number of sheets of paper which form book block 30. From this count and a known thickness or weight of the paper, the thickness of book block 30 can be calculated. As such, the thickness of book block 30 is communicated to scoring apparatus 50 such that predetermined distance d can be established.

As illustrated in FIG. 4B, cover blank 20 is positioned between scoring counter-bars 60 and scoring tools 70 such that centerline 26 of cover blank 20 is registered to centerline 51 of scoring apparatus 50. With scoring counter-bars 60 and scoring tools 70, a predetermined pressure suitable for permanently forming scorelines 28 and scorelines 29 is applied to cover blank 20. As such, scoring rib 72 of each of the scoring tools 70 cooperates with groove 66 of an associated one of the scoring counter-bars 60 to form scorelines 28 in cover blank 20. In addition, scoring groove 74 of each of the scoring tools 70 cooperates with rib 67 of the associated scoring counter-bars 60 to form scorelines 29 in cover blank 20.

As scoring wheels 80 roll along scoring counter-bars 60, point contact is maintained against cover blank 20 by scoring wheels 80 and scoring counter-bars 60. As such, pressure is applied to cover blank 20 as scoring wheels 80 roll along cover blank 20 and scoring counter-bars 60. Thus, scorelines 28 and scorelines 29 are simultaneously formed in cover blank 20 by permanently deforming cover blank 20 under pressure. It is understood that a size and shape of scoring rib 72 and scoring groove 74 of scoring tools 70 and groove 66 and rib 67 of scoring counter-bars 60 can be varied according to a desired profile of scorelines 28 and scorelines 29.

Figure 5A:
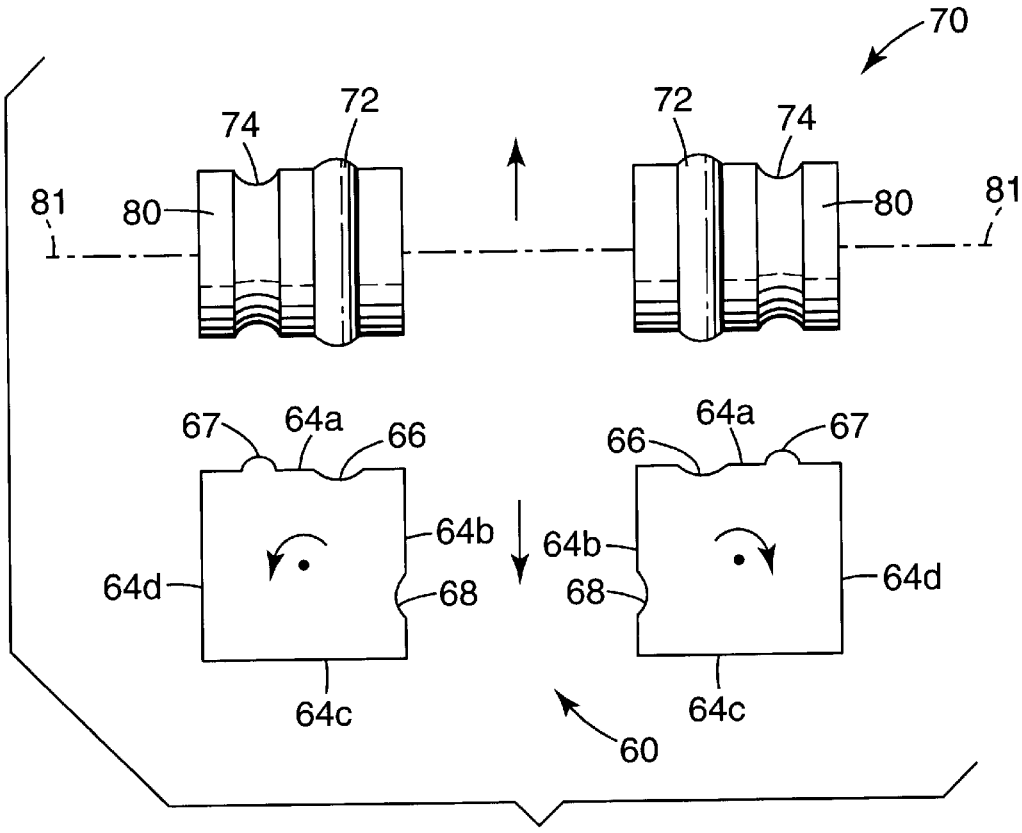
FIG. 5A is an end view illustrating one exemplary embodiment of a reconfiguration of the scoring apparatus of FIG. 3.
Figure 5B:
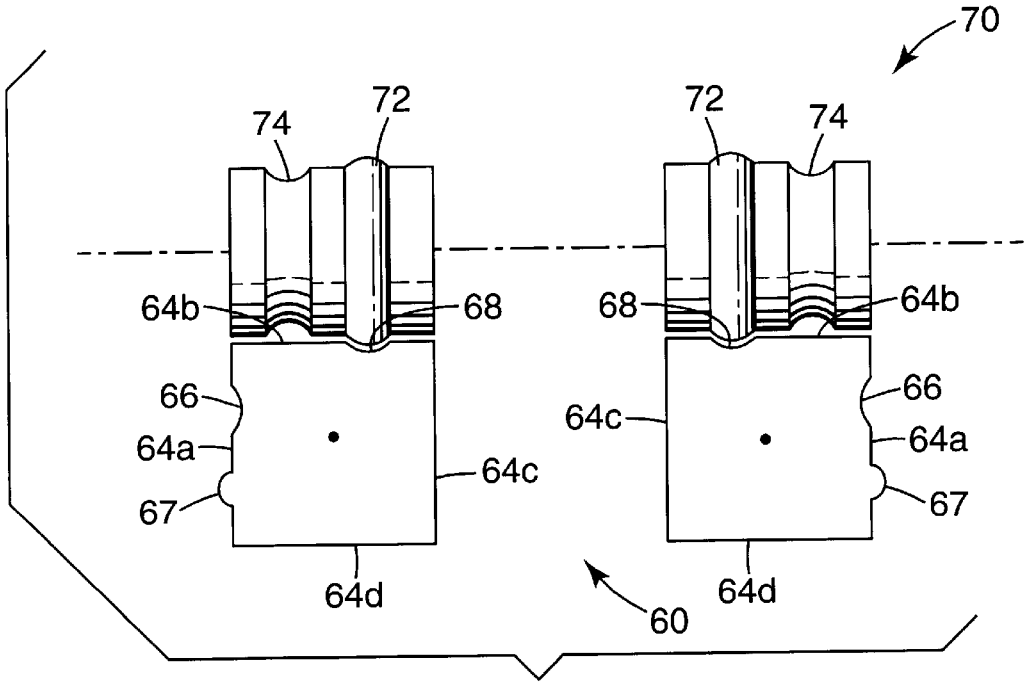
FIG. 5B is an end view of a portion of the scoring apparatus of FIG. 3.
Figure 5C:
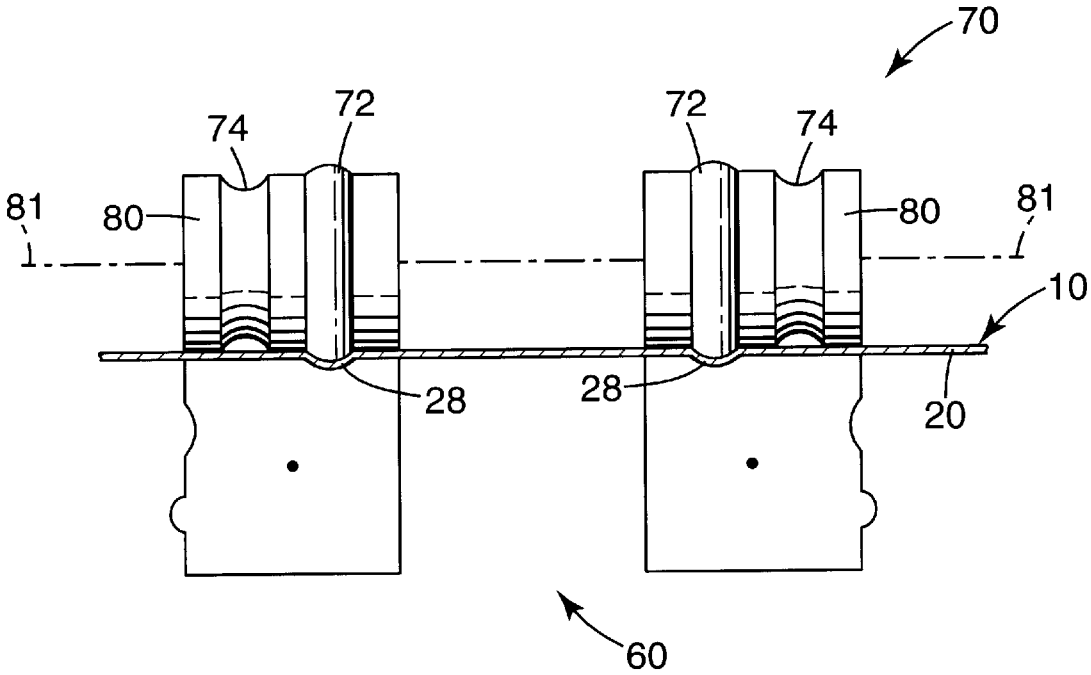
FIG. 5C is an end view illustrating another exemplary embodiment of forming scorelines in a book cover positioned in the scoring apparatus of FIG. 3.

FIGS. 5A–5C illustrate one exemplary embodiment of forming scorelines 28 in cover blank 20 with scoring apparatus 50 to form book cover 110. As illustrated in FIG. 5A, scoring tools 70 and scoring counter-bars 60 are spaced vertically relative to each other to permit rotation of scoring counter-bars 60 about longitudinal axis 61. Accordingly, scoring counter-bars 60 are each rotated about longitudinal axis 61 by, for example, controller 56 such that side surface 64*b* of each of the scoring counter-bars 60 faces the associated scoring tools 70, as illustrated in FIG. 5B. Thus, side surface 64*c* of each of the scoring counter-bars 60 faces centerline 51 of scoring apparatus 50 and, therefore, the other scoring counter-bar 60.

As illustrated in FIG. 5C, cover blank 20 is positioned between scoring counter-bars 60 and scoring tools 70 such that centerline 26 of cover blank 20 is registered to centerline 51 of scoring apparatus 50. With scoring counter-bars 60 and scoring tools 70, a predetermined pressure suitable for permanently forming scorelines 28 is applied to cover blank 20. As such, scoring rib 72 of each of the scoring tools 70 cooperates with groove 68 of an associated one of the scoring counter-bars 60 to form scorelines 28 in cover blank 20. Thus, scorelines 28 are formed in cover blank 20 by permanently deforming cover blank 20 under pressure. It is understood that a size and shape of groove 68 of scoring counter-bars 60 can also be varied according to the desired profile of scorelines 28.

Figure 6:
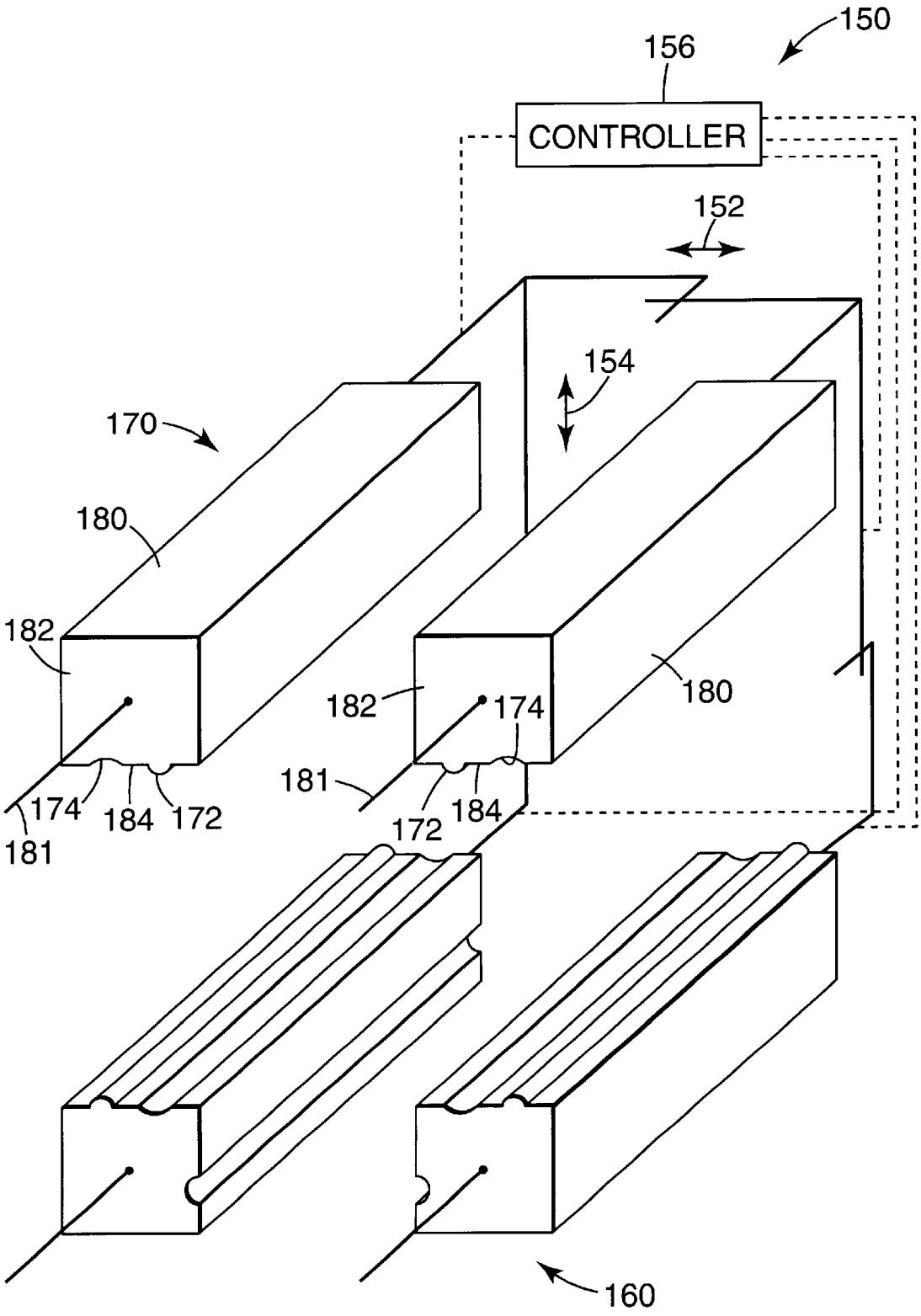
FIG. 6 is a schematic illustration of another exemplary embodiment of a portion of a scoring apparatus for forming scorelines in a book cover according to the present invention.

Another exemplary embodiment of a portion of a scoring apparatus for forming scorelines 28 and scorelines 29 in book cover 10 and scorelines 28 in book cover 110 is illustrated generally at 150 in FIG. 6. Scoring apparatus 150 includes a pair of scoring counter-bars 160 and a pair of scoring tools 170. Scoring counter-bars 160 are similar to scoring counter-bars 60 of scoring apparatus 50. In addition, scoring tools 170 each include a scoring rib 172 and a scoring groove 174 similar to scoring tools 70 of scoring apparatus 50. Thus, cooperation and association of scoring counter-bars 160 and scoring tools 170 is similar to that of scoring counter-bars 60 and scoring tools 70 of scoring apparatus 50. Scoring counter-bars 160 and scoring tools 170, for example, are jointly adjustable laterally as represented by arrow 152 and vertically adjustable relative to each other as represented by arrow 154. Operation of scoring apparatus 150 including, for example, adjustment of scoring counter-bars 160 and scoring tools 170 is controlled by a controller 156.

Scoring apparatus 150 is similar to scoring apparatus 50 with the exception that the pair of scoring tools 170 includes a pair of scoring bars 180. Scoring bars 180 each have a longitudinal axis 181 and are oriented substantially parallel to each other and to scoring counter-bars 160. Scoring bars 180 each have a pair of end surfaces 182 (only one of which is illustrated) through which longitudinal axis 181 extends. In addition, scoring bars 180 each include at least one side surface 184 extending between end surfaces 182 parallel with longitudinal axis 181. As such, scoring rib 172 of each of the scoring tools 170 extends longitudinally along side surface 184 of a corresponding one of the scoring bars 180 and scoring groove 174 of each of the scoring tools 170 extends longitudinally along side surface 184 of the corresponding scoring bars 180.

One of the scoring bars 180 cooperates with one of the scoring counter-bars 160. Thus, line contact is provided between scoring bars 180 and scoring counter-bars 160 as scoring bars 180 are pressed against scoring counter-bars 160. Forming scorelines 28 and scorelines 29 in cover blank 20 with scoring apparatus 150 to form book covers 10 and 110 is similar to that described in connection with scoring apparatus 50.

By forming scorelines in book covers 10 or 110 prior to binding of book block 30 with book covers 10 or 110, scoring apparatuses 50 and 150 ensure that precise fold-lines are provided along lateral edges of cover spines 16 and 116, respectively. Thus, positioning and facilitating of folds in cover blank 20 is provided.

Figure 7:
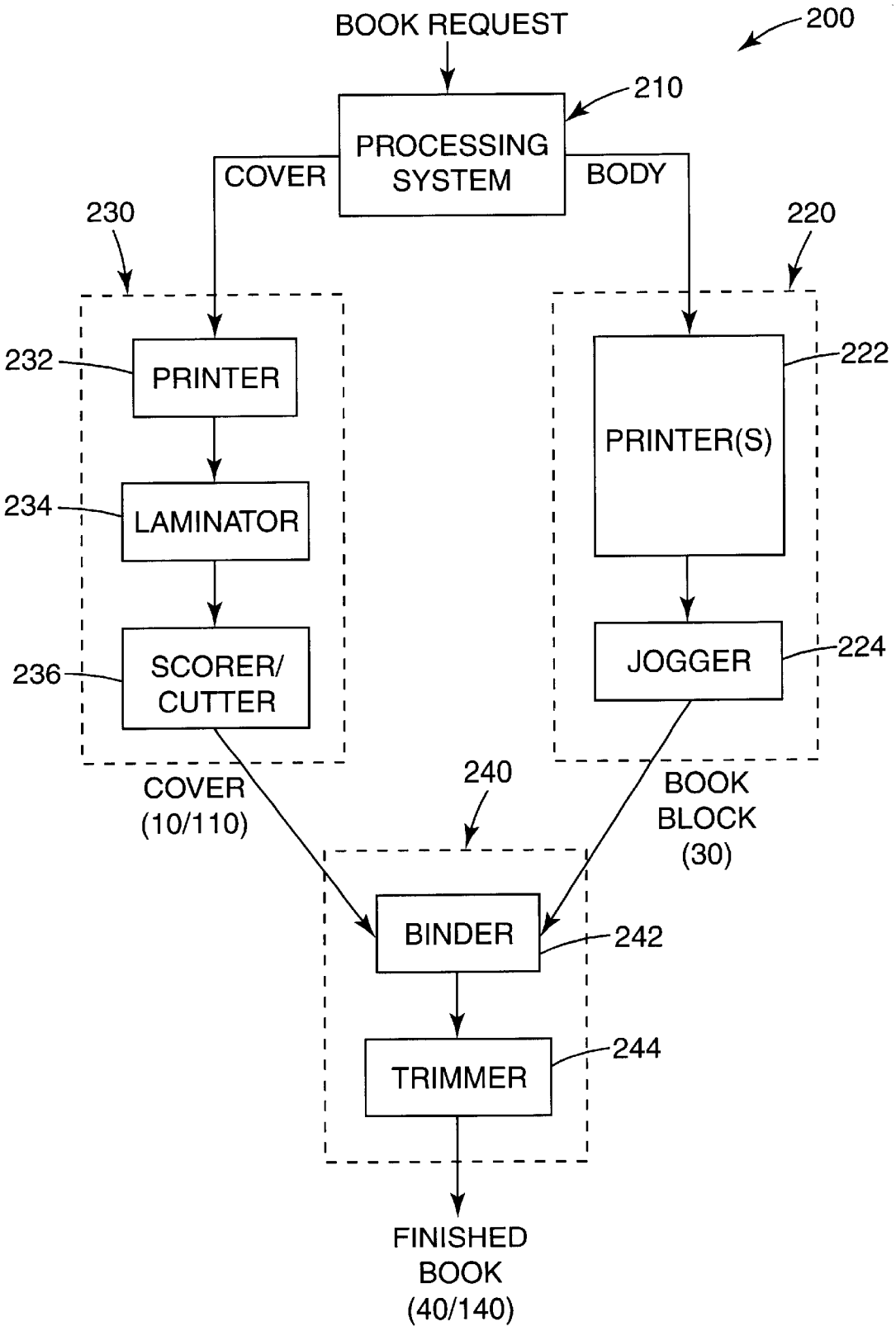
FIG. 7 is a block diagram illustrating one exemplary embodiment of a books-on-demand system including a scoring apparatus according to the present invention.

In one illustrative embodiment, book covers 10 and 110 are formed in a books-on-demand system illustrated generally at 200 in FIG. 7. Books-on-demand system 200 receives orders for single and/or multiple copies of a book and produces the book on-demand. More specifically, books-on-demand system 200 retrieves an electronic file of the book and then prints and binds a copy of the book.

In one exemplary embodiment, books-on-demand system 200 includes a processing system 210, a book block preparation system 220, a book cover preparation system 230, and a book finishing system 240. In one exemplary embodiment, processing system 210 includes hardware and software for receiving and processing a book request. Processing system 210 retrieves an electronic file of a book being requested and produces a print command for a body of the book including, for example, a table of contents, the text, and an index, and produces a print command for a cover of the book. In response to the print commands, book block preparation system 220 and book cover preparation system 230 prepare book block 30 and book cover 10 or 110, respectively. Thereafter, book finishing system 240 assembles book block 30 and book cover 10 or 110 to form book 40 or 140, respectively.

In one exemplary embodiment, book block preparation system 220 includes one or more printers 222 and a jogger 224. Printer 222 is a black and white printer and prints the body of book 40 or 140 on several sheets of paper. Jogger 224 vibrates or shakes the sheets to align the edges of the paper in forming book block 30.

In one exemplary embodiment, book cover preparation system 230 includes a printer 232, a laminator 234, and a scorer/cutter 236 which includes scoring apparatus 50 or 150. Printer 232 is a color printer and prints book cover 10 or 110. Laminator 234 laminates cover blank 20 and scorer/cutter 236 forms scorelines 28 and scorelines 29 and/or scorelines 28 in cover blank 20 as described above.

In one exemplary embodiment, book finishing system 240 includes a book binder 242 and a book trimmer 244. As such, cover blank 20 is registered in book binder 242 and book block 30 is positioned on cover blank 20. Then, book block 30 is bound with book cover 10 or 110 by book binder 242 as is well known in the art. Thereafter, book trimmer 244 trims cover blank 20 if necessary. Thus, finished book 40 or 140 is produced.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An apparatus for forming scorelines in a book cover, the apparatus comprising:

a pair of scoring counter-bars each having a longitudinal axis and a first surface substantially parallel with the longitudinal axis, each of the scoring counter-bars including a first longitudinal indentation provided in the first surface thereof and extended substantially parallel with the longitudinal axis; and a pair of scoring tools each including a scoring protrusion provided thereon, the scoring protrusion of one of the scoring tools adapted to engage the first longitudinal indentation of an associated one of the scoring counter-bars.

2. The apparatus of claim 1, wherein the pair of scoring tools includes a pair of scoring wheels, and wherein the scoring protrusion of each of the scoring tools is a circumferential scoring protrusion.

3. The apparatus of claim 1, wherein the pair of scoring tools includes a pair of scoring bars, and wherein the scoring protrusion of each of the scoring tools is a longitudinal scoring protrusion.

4. The apparatus of claim 1, wherein each of the scoring counter-bars includes a longitudinal protrusion provided on the first surface thereof, and wherein each of the scoring tools includes a scoring indentation provided therein, the scoring indentation of the one of the scoring tools adapted to receive the longitudinal protrusion of the associated one of the scoring counter-bars.

5. The apparatus of claim 1, wherein each of the scoring counter-bars have a second surface substantially parallel with the longitudinal axis thereof, each of the scoring counter-bars including a second longitudinal indentation provided in the second surface thereof and a longitudinal protrusion provided on the second surface thereof, and wherein each of the scoring tools includes a scoring indentation provided therein, the scoring indentation of the one of the scoring tools adapted to receive the longitudinal protrusion of the associated one of the scoring counter-bars and the scoring protrusion of the one of the scoring tools adapted to engage the second longitudinal indentation of the associated one of the scoring counter-bars.

6. The apparatus of claim 5, wherein the second surface of each of the scoring counter-bars is substantially perpendicular to the first surface thereof, and wherein each of the scoring counter-bars is rotatable about the longitudinal axis thereof between a first position which facilitates engagement of the first longitudinal indentation of one of the scoring counter-bars by the scoring protrusion of an associated one of the scoring tools and a second position which facilitates engagement of the second longitudinal indentation of the one of the scoring counter-bars by the scoring protrusion of the associated one of the scoring tools.

7. The apparatus of claim 6, wherein the pair of scoring tools includes a pair of scoring wheels, and wherein the scoring protrusion of each of the scoring tools is a circumferential scoring protrusion and the scoring indentation of each of the scoring tools is a circumferential scoring indentation.

8. The apparatus of claim 6, wherein the pair of scoring tools includes a pair of scoring bars, and wherein the scoring protrusion of each of the scoring tools is a longitudinal scoring protrusion and the scoring indentation of each of the scoring tools is a longitudinal scoring indentation.

9. The apparatus of claim 1, wherein at least one of the scoring counter-bars and an associated one of the scoring tools are jointly adjustable laterally.

10. The apparatus of claim 1, wherein a first of the scoring counter-bars and an associated one of the scoring tools are jointly adjustable laterally in a first direction substantially perpendicular to the longitudinal axis of the first of the scoring counter-bars, and wherein a second of the scoring counter-bars and an associated one of the scoring tools are jointly adjustable laterally in a second direction substantially perpendicular to the longitudinal axis of the second of the scoring counter-bars, the second direction being opposite to the first direction.

11. The apparatus of claim 1, wherein one of the scoring counter-bars and an associated one of the scoring tools are spaced a predetermined distance from another of the scoring counter-bars and an associated one of the scoring tools based on a thickness of a book block adapted to be bound with the book cover.

12. The apparatus of claim 1, further comprising:

a controller adapted to control the scoring counter-bars and the scoring tools.

13. An apparatus for forming scorelines in a book cover, the apparatus comprising:

a pair of scoring counter-bars each having a longitudinal axis and a first surface substantially parallel with the longitudinal axis, each of the scoring counter-bars including a first indentation provided in the first surface thereof and a first protrusion provided on the first surface thereof, the first indentation and the first protrusion of each of the scoring counter-bars extending longitudinally along the first surface thereof substantially parallel with the longitudinal axis thereof; and a pair of scoring tools each including a scoring protrusion adapted to engage the first indentation of an associated one of the scoring counter-bars and a scoring indentation adapted to receive the first protrusion of the associated one of the scoring counter-bars.

14. The apparatus of claim 13, wherein the pair of scoring tools includes a pair of scoring wheels, and wherein the scoring protrusion of each of the scoring tools extends circumferentially around a corresponding one of the scoring wheels and the scoring indentation of each of the scoring tools extends circumferentially around the corresponding one of the scoring wheels.

15. The apparatus of claim 13, wherein the pair of scoring tools includes a pair of scoring bars each having a longitudinal axis and a surface substantially parallel with the longitudinal axis, and wherein the scoring protrusion of each of the scoring tools extends longitudinally along the surface of a corresponding one of the scoring bars and the scoring indentation of each of the scoring tools extends longitudinally along the surface of the corresponding one of the scoring bars.

16. The apparatus of claim 13, wherein each of the scoring counter-bars have a second surface substantially parallel with the longitudinal axis thereof, each of the scoring counter-bars including a second indentation provided in the second surface thereof, the second indentation of each of the scoring counter-bars extending longitudinally along the second surface thereof substantially parallel with the longitudinal axis thereof, and wherein the scoring protrusion of one of the scoring tools is adapted to engage the second indentation of an associated one of the scoring counter-bars.

17. The apparatus of claim 16, wherein the second surface of each of the scoring counter-bars is substantially perpendicular to the first surface thereof, and wherein each of the scoring counter-bars is rotatable about the longitudinal axis thereof between a first position which facilitates engagement of the first indentation of one of the scoring counter-bars by the scoring protrusion of an associated one of the scoring tools and a second position which facilitates engagement of the second indentation of the one of the scoring counter-bars by the scoring protrusion of the associated one of the scoring tools.

18. The apparatus of claim 13, wherein at least one of the scoring counter-bars and an associated one of the scoring tools are jointly adjustable laterally.

19. The apparatus of claim 13, wherein a first of the scoring counter-bars and an associated one of the scoring tools are jointly adjustable laterally in a first direction substantially perpendicular to the longitudinal axis of the first of the scoring counter-bars, and wherein a second of the scoring counter-bars and an associated one of the scoring tools are jointly adjustable laterally in a second direction substantially perpendicular to the longitudinal axis of the second of the scoring counter-bars, the second direction being opposite to the first direction.

20. The apparatus of claim 13, wherein one of the scoring counter-bars and an associated one of the scoring tools are spaced a predetermined distance from another of the scoring counter-bars and an associated one of the scoring tools based on a thickness of a book block adapted to be bound with the book cover.

21. The apparatus of claim 13, further comprising:

a controller adapted to control the scoring counter-bars and the scoring tools.

22. A method of preparing a book cover prior to binding of a book block with the book cover, the method comprising the steps of:

providing a pair of scoring counter-bars and a pair of scoring tools;

establishing a thickness of the book block;

spacing the pair of scoring counter-bars and the pair of scoring tools based on the established thickness of the book block, including spacing one of the scoring counter-bars and an associated one of the scoring tools a predetermined distance from another of the scoring counter-bars and an associated one of the scoring tools based on the established thickness of the book block;

positioning the book cover between the pair of scoring counter-bars and the pair of scoring tools; and applying pressure to the book cover from the pair of scoring counter-bars and the pair of scoring tools to form a first pair of scorelines in the book cover.

23. The method of claim 22, wherein each of the scoring counter-bars include a first indentation provided in a first surface thereof and a second indentation provided in a second surface thereof and each of the scoring tools include a scoring protrusion, and wherein the step of providing the pair of scoring counter-bars and the pair of scoring tools includes rotating each of the scoring counter-bars about a longitudinal axis thereof between a first position which facilitates engagement of the first indentation of one of the scoring counter-bars by the scoring protrusion of an associated one of the scoring tools and a second position which facilitates engagement of the second indentation of the one of the scoring counter-bars by the scoring protrusion of the associated one of the scoring tools.

24. The method of claim 22, wherein the step of applying pressure to the book cover includes forming a second pair of scorelines in the book cover simultaneously with the first pair of scorelines, the second pair of scorelines being centered about and spaced laterally from the first pair of scorelines.

25. The method of claim 22, wherein each of the scoring counter-bars include an indentation provided in a surface thereof and each of the scoring tools include a scoring protrusion, and wherein the step of applying pressure to the book cover includes engaging the indentation of one of the scoring counter-bars with the scoring protrusion of an associated one of the scoring tools.

26. The method of claim 25, wherein each of the scoring counter-bars include a protrusion provided on the surface thereof and each of the scoring tools include a scoring indentation, and wherein the step of applying pressure to the book cover further includes engaging the scoring indentation of the associated one of the scoring tools with the protrusion of the one of the scoring counter-bars.

27. A system for producing a book on-demand, the system comprising:

a processing system adapted to receive and process a book request for the book, the processing system adapted to retrieve a data file which includes contents of the book and produce a book body preparation command and a book cover preparation command from the data file;

a book block preparation system which prepares a book block of the book in response to the book body preparation command;

a book cover preparation system which prepares a book cover of the book in response to the book cover preparation command; and a book finishing system which assembles the book block and the book cover to form the book, wherein the book cover preparation system includes a pair of scoring counter-bars and a pair of scoring tools, each the scoring counter-bars having a longitudinal axis and a first surface substantially parallel with the longitudinal axis, each of the scoring counter-bars including a first longitudinal indentation provided in the first surface thereof and extended substantially parallel with the longitudinal axis and each of the scoring tools including a scoring protrusion provided thereon, the scoring protrusion of one of the scoring tools adapted to engage the first longitudinal indentation of an associated one of the scoring counter-bars.

28. A method of producing a book on-demand, the method comprising the steps of:

receiving and processing a book request for the book including retrieving a data file which includes contents of the book and producing a book body preparation command and a book cover preparation command from the data file;

preparing a book block of the book in response to the book body preparation command;

preparing a book cover of the book in response to the book cover preparation command; and assembling the book block and the book cover to form the book, wherein the step of preparing the book cover includes the steps of:

providing a pair of scoring counter-bars and a pair of scoring tools, establishing a thickness of the book block, spacing the pair of scoring counter-bars and the pair of scoring tools based on the established thickness of the book block, including spacing one of the scoring counter-bars and an associated one of the scoring tools a predetermined distance from another of the scoring counter-bars and an associated one of the scoring tools based on the established thickness of the book block, positioning the book cover between the pair of scoring counter-bars and the pair of scoring tools, and applying pressure to the book cover from the pair of scoring counter-bars and the pair of scoring tools to form a first pair of scorelines in the book cover.

* * * * *